US005193566A

United States Patent [19]

Chen

[11] Patent Number: 5,193,566

[45] Date of Patent: Mar. 16, 1993

[54] UMBRELLA FRAME

[75] Inventor: Wei-Kun Chen, Taoyuan, Taiwan

[73] Assignee: Ocean Import Export Inc., Richmond, Canada

[21] Appl. No.: 843,632

[22] Filed: Feb. 28, 1992

[51] Int. Cl.[5] ..... A45B 25/06

[52] U.S. Cl. ..... 135/28; 135/29; 135/31; 403/341; 403/405.1

[58] Field of Search ..... 135/29, 25.31, 25.3, 135/25.33, 28, 26, 31, 30, 37-39, 41, 15.1; 403/341, 405.1, 408.1

[56] References Cited

U.S. PATENT DOCUMENTS

| | | | |
|---|---|---|---|
| 1,429,828 | 9/1922 | Baker | 135/28 |
| 1,593,494 | 7/1926 | Henry | 135/28 |
| 1,808,610 | 6/1931 | Roy | 135/28 |
| 2,321,495 | 6/1943 | Levin | 135/28 |
| 2,385,575 | 9/1945 | Isler | 135/29 |
| 2,953,400 | 9/1960 | Miller | 135/29 X |
| 4,368,749 | 1/1983 | Lindler et al. | 135/28 X |
| 4,710,052 | 12/1987 | Elger | 403/341 X |
| 5,085,239 | 2/1992 | Chin-Hung et al. | 135/25.33 |
| 5,098,216 | 3/1992 | Caperton | 403/341 |

*Primary Examiner*—Richard E. Chilcot, Jr.
*Assistant Examiner*—Lan M. Mai
*Attorney, Agent, or Firm*—Wells, St. John, Roberts, Gregory & Matkin

[57] ABSTRACT

An umbrella frame having a pair of mounting rings and frame members which are pivotally connected to each other and to the mounting rings. A frame member having an elongated rod with a notch. A joint assembly is attached to the elongated rod and includes laterally opposed connector halves which mate to form a sleeve over the elongated rod. The sleeve has an inner boss which fits within the notch in the elongated rod when the connector halves are mated over the elongated rod. A collar slides around the mated connector halves to clamp the connector halves together over the elongated rod and to retain the inner boss within the notch in the elongated rod. Strut frame members have an end joint assembly at each end. Rib frame members have an end joint assembly at their inner ends and midpoint joint assemblies at rib midpoints. A mounting ring having a mounting base with a ring of spaced and vertically extending teeth. The frame members are received between the teeth. The teeth radially retain the frame members within the mounting base by engaging the frame member pivot lugs. A mounting cap has radially extending spaced teeth which fit between the teeth of the mounting base to retain the frame members within the mounting base. A lower mounting ring slides along the umbrella shaft to form an umbrella runner.

20 Claims, 3 Drawing Sheets

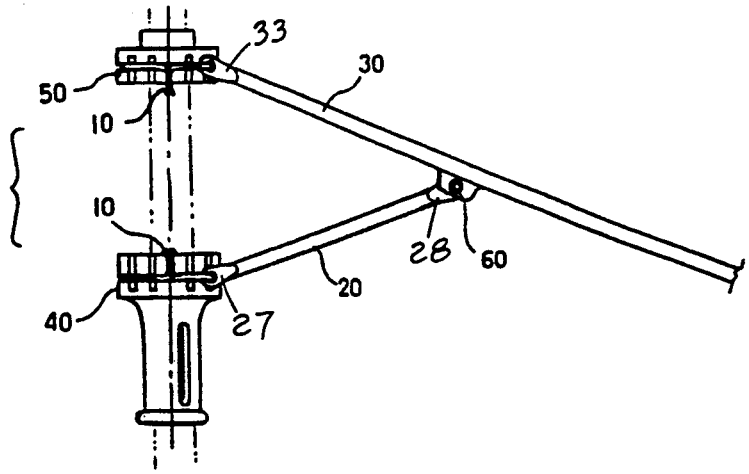
Fig 1
PRIOR ART
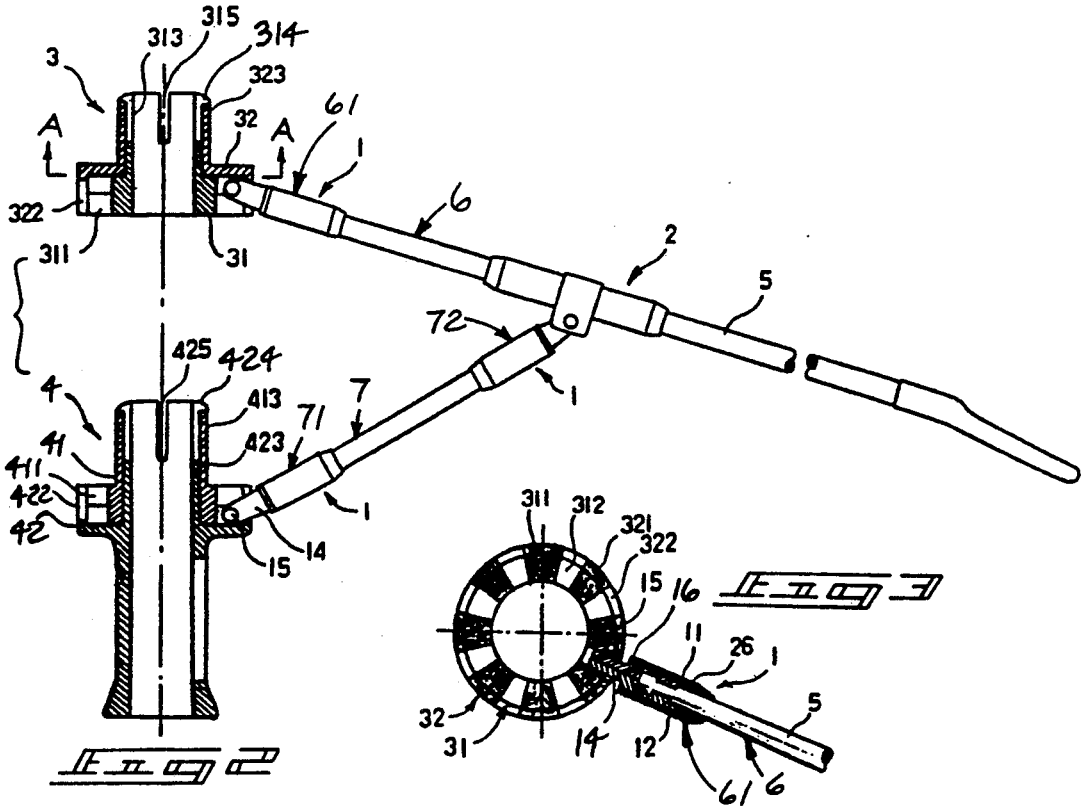
Fig 2
Fig 3

UMBRELLA FRAME

TECHNICAL FIELD

This invention relates to umbrella frames and to devices for pivotally connecting umbrella frame members within an umbrella frame.

BACKGROUND OF THE INVENTION

FIG. 1 shows a portion of a prior art umbrella frame. Such an umbrella frame typically includes a plurality of umbrella struts 20 and umbrella ribs 30. Each umbrella rib 30 has an inner end 33 which is pivotally connected to an upper mounting ring 50. Each strut 20 has an inner end 27 which is pivotally connected to a lower mounting ring or umbrella runner 40. Each strut 20 has an outer end 28 which is pivotally connected to a midpoint of a corresponding rib 30. Upper mounting ring 50 is attached to the upper end of an umbrella central shaft (shown in phantom) while runner 40 is slidably received over the central shaft. Runner 40 and inner ends 27 of struts 20 are raised as shown to support ribs 30 in their open positions. Runner 40 is lowered (not shown) to close the umbrella.

Struts 20 and ribs 30 are connected to their respective mounting rings 40 and 50 by wires 10 which surround each mounting ring and which are received by apertures in inner ends 27 and 33 of struts 20 and ribs 30. Struts 20 are connected to the midpoints of ribs 30 by rivets 60.

Such connections are difficult and costly to fabricate, requiring special machinery for both wires 10 and rivets 60. In addition, typical umbrella frames are constructed of steel which is prone to rusting and which can become quite heavy as the size of the umbrella increases. The invention described below provides an umbrella frame which is easily assembled without special tools. Furthermore, the unique construction described is particularly compatible with light-weight plastic construction, thereby providing a much lighter weight umbrella frame than has generally been available.

BRIEF DESCRIPTION OF THE DRAWINGS

A preferred embodiment of the invention is described below with reference to the accompanying drawings in which:

FIG. 1 is a side view of a portion of a prior art umbrella frame;

FIG. 2 is a side view of a preferred umbrella frame embodiment in accordance with the invention, including upper and lower mounting rings which are sectioned to show their inner construction;

FIG. 3 is a sectioned bottom view of the upper mounting ring shown in FIG. 2, taken along the line a—a of FIG. 2;

DETAILED DESCRIPTION OF THE PREFERRED EMBODIMENT

This disclosure of the invention is submitted in furtherance of the constitutional purposes of the U.S. Patent Laws "to promote the progress of science and useful arts." U.S. Constitution, Article 1, Section 8.

Figure 4:
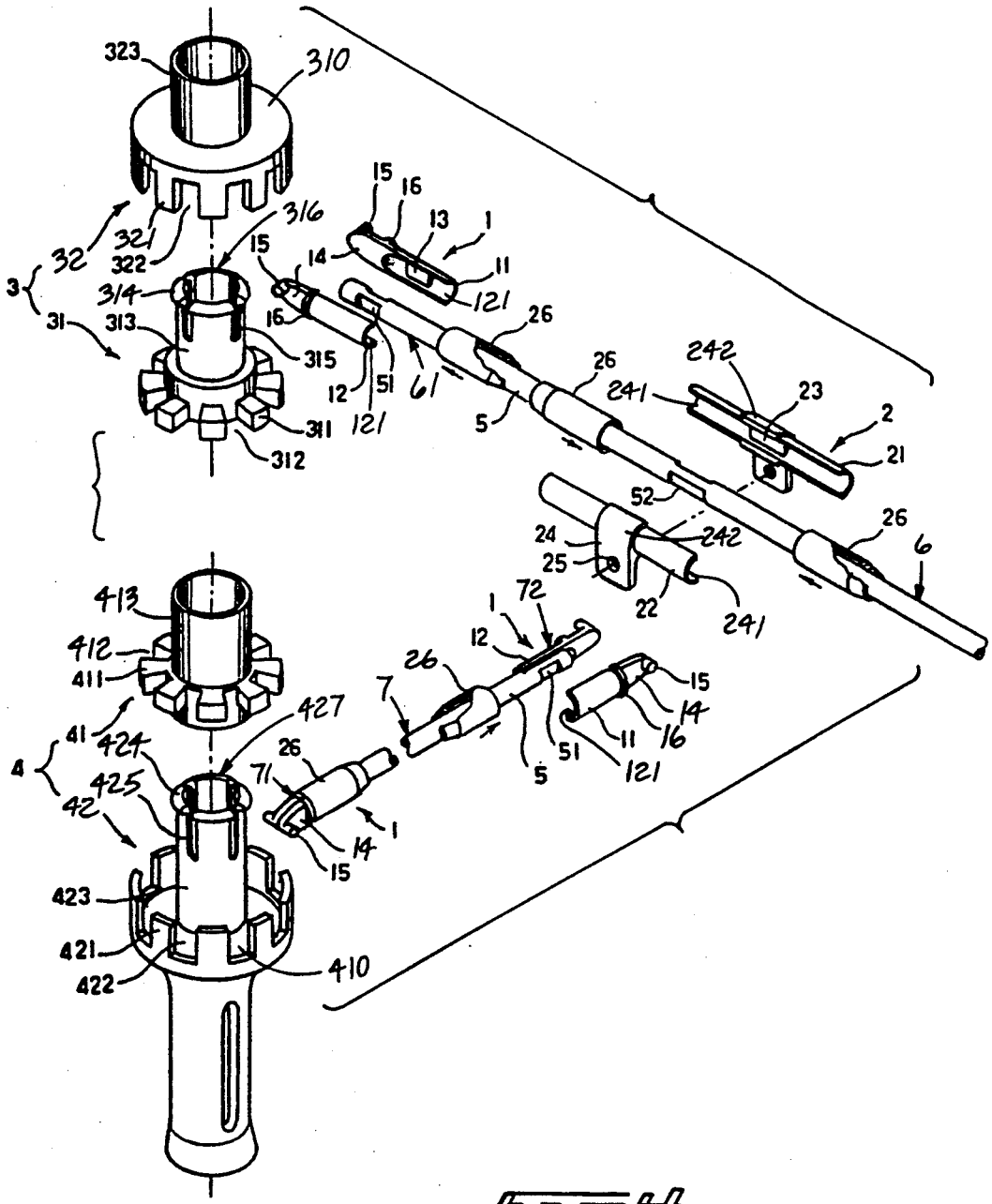
FIG. 4 is an exploded view of the umbrella frame shown in FIG. 2.
Figure 6:
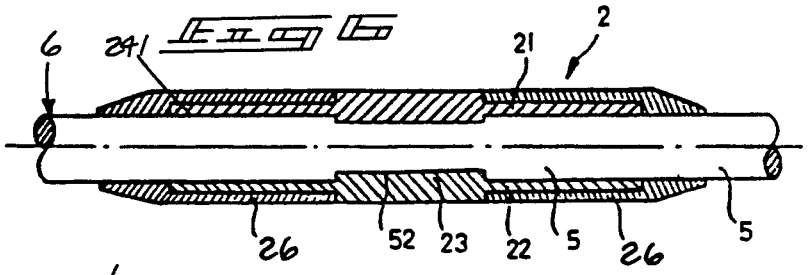
FIG. 6 is a top cross-section of the rib midpoint joint assembly shown in FIG. 2.
Figure 5:
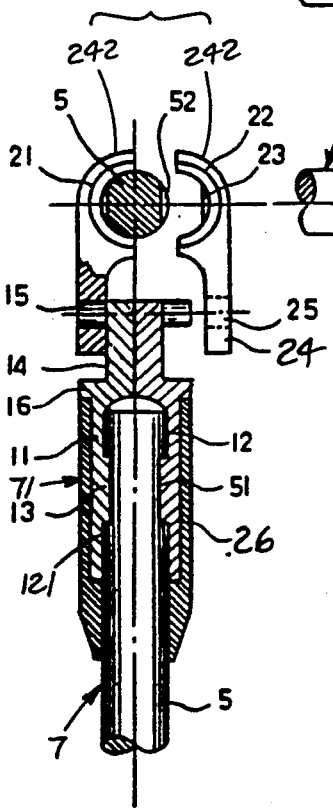
FIG. 5 is a cross-section of the umbrella strut outer end shown in FIG. 2, including an outer strut end joint assembly and a rib midpoint joint assembly.
Figure 7:
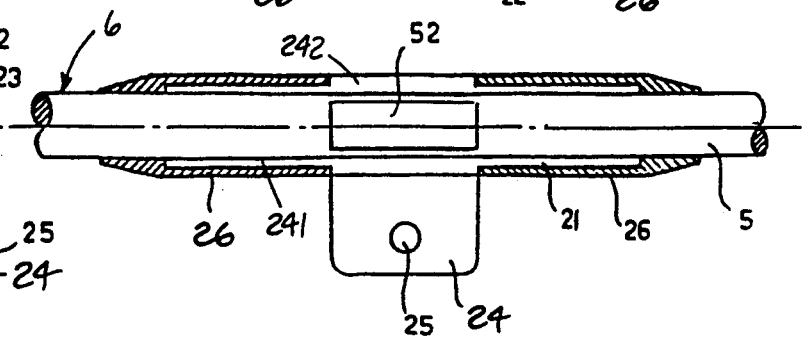
FIG. 7 is a side cross-section of the rib midpoint joint assembly shown in FIG. 2.

FIGS. 2–7 show a portion of an umbrella frame in accordance with the invention. The frame generally comprises an upper mounting ring 3, a lower mounting ring or runner 4, and a plurality of radially extending frame members such as umbrella rib frame members 6 and umbrella strut frame members 7. Mounting rings 3 and 4 are received over a central umbrella shaft which has not been shown. For clarity, only a single rib frame member 6 and single strut frame member 7 are illustrated.

Each of frame members 6 and 7 comprises an elongated rod 5. Elongated rods 5, as well as other components described below, are preferably fabricated from a reinforced plastic such as fiber reinforced plastic (FRP). Such a plastic provides superior strength while keeping the overall weight of the umbrella frame to a minimum.

Strut frame member 7 is provided with an end joint assembly 1 at both its inner end 71 and its outer end 72. Rib frame member 6 is provided with an identical end joint assembly 1 at its inner end 61. In addition, rib frame member 6 has a midpoint joint assembly 2 which connects a midpoint of rib frame member 6 to outer end 72 of strut frame member 7.

End joint assembly 1 has an end section 14 and opposed pivot lugs 15 which extend laterally from either side of end section 14. End joint assemblies 1 are attached to ends of elongated rods 5 as required to provide pivot lugs 15 at said ends of elongated rods 5.

Midpoint joint assembly 2 has projecting tab extensions 24 with aligned lateral apertures 25. Apertures 25 correspond in size and spacing to opposed pivot lugs 15 on outer end 72 of strut frame member 7, said pivot lugs 15 being received by apertures 25. Pivot lugs 15 at outer end 72 of strut frame member 7 and apertures 25 provide a hinged joint between strut frame member 7 and rib frame member 6. The hinged connection allows strut frame member 7 to pivot relative to rib frame member 6.

Inner ends 61 and 71 of rib frame member 6 and strut frame member 7 are pivotally received by upper and lower mounting rings 3 and 4. More specifically, the mounting rings pivotally receive the laterally extending pivot lugs at the end sections of the connector halves. Lower mounting ring 4 is an umbrella runner which slides over the umbrella central shaft to open and close the umbrella. Lower mounting ring 4 is raised so that strut frame member 7 forces rib frame member 6 outward and upward to open the umbrella. Lower mounting ring 4 is lowered so that strut frame member 7 pulls rib frame member 6 inward and downward to close the umbrella.

Frame member construction is best illustrated by FIGS. 4–7. Elongated rod 5 of strut frame member 7 has at least one notch 51 formed therein adjacent its outer end 72, and preferably an opposed pair of lateral notches 51 formed in opposition to one another. End joint assembly 1 at outer end 72 comprises a pair of laterally opposed connector halves 11 and 12 which surround elongated rod 5 in opposition to one another, forming a sleeve 121 over elongated rod 5 of strut frame member 7. Sleeve 121 has an inner boss 13 corresponding to each notch 51 in outer end 72. In the preferred embodiment shown, each of opposed connector halves 11 and 12 includes an inner boss 13 which aligns with one of opposed lateral notches 51. Inner bosses 13 are complementary in size and shape to lateral notches 51.

Each inner boss 13 fits within the corresponding notch 51 when connector halves 11 and 12 are mated over elongated rod 5. A collar 26 is slidably mounted on elongated rod 5 about connector halves 11 and 12. Collar 26 slides around connector halves 11 and 12 to clamp them together about elongated rod 5 and to retain inner bosses 13 within the corresponding notches 51. Inner bosses 13 therefore limit longitudinal movement of end joint assembly 1 relative to elongated rod 5. A collar stop 16, comprising an enlarged shoulder on end joint assembly 1, positions collar 26 relative to end joint assembly 1. End sections 14 are connected to each connector half 11 and 12, protruding beyond elongated rod 5. Each end section 14 has a laterally extending pivot lug 15 formed thereon.

An identical end joint assembly 1 is mounted in similar fashion to inner ends 61 and 71 of rib frame member 6 and strut frame member 7.

Midpoint joint assembly 2 is attached to rib frame member 6 in the same manner as end joint assemblies 1 are attached to the frame members. Elongated rod 5 of rib frame member 6 has at least one notch 52 formed therein intermediate its ends, and preferably a pair of lateral notches 52 formed in opposition to one another. Midpoint joint assembly 2 comprises a pair of laterally opposed connector halves 21 and 22 which surround elongated rod 5 in opposition to one another, forming a sleeve 241 over elongated rod 5. Sleeve 241 has an inner boss 23 corresponding to each notch 52 in elongated rod 5. In the preferred embodiment shown, each of opposed connector halves 21 and 22 includes an inner boss 23 which aligns with one of opposed lateral notches 52. Inner bosses 23 are complementary in size and shape to lateral notches 52.

Each inner boss 23 fits within the corresponding notch 52 when connector halves 21 and 22 are mated over elongated rod 5 of rib frame member 6. Two collars 26 are slidably mounted about connector halves 21 and 22. Collars 26 slide around mated connector halves 21 and 22 from opposite longitudinal directions to clamp connector halves 21 and 22 together about elongated rod 5 and to retain inner bosses 23 within the corresponding notches 52. Inner bosses 23 therefore limit longitudinal movement of midpoint joint assembly 2 relative to elongated rod 5.

Each of connector halves 21 and 22 includes a center section 242 having a tab extension 24. Each tab extension 24 has a lateral aperture 25 adapted to receive one pivot lug of connector halves 11 and 12 with the end sections of connector halves 11 and 12 overlapped by tab extensions 24 of connector halves 21 and 22 to thereby pivotally interconnect rods 5 and 6. Center section 242 also forms a collar stop around midpoint joint assembly 2, positioning collars 26 relative to midpoint joint assembly 7.

Lower mounting ring 4 comprises a lower mounting base 42 and a lower mounting cap 41. Lower mounting base 42 has a longitudinal central lower base sleeve 423 which slides over the umbrella central shaft. A flange 410 extends radially from lower base sleeve 423. A ring of spaced retaining teeth 421 extend vertically upward from the periphery of the flange. Spaces 422 are formed between lower base teeth 421.

Lower mounting cap 41 has a longitudinal central cap sleeve 413 which receives the umbrella central shaft. Lower mounting cap 41 has spaced teeth 411 which extend radially from lower cap sleeve 413. Lower cap teeth 411 are complementary in size to spaces 422 of lower mounting base 42. Spaces 412 are formed between lower cap teeth 411, spaces 412 being complementary in size to lower base teeth 421.

Strut frame members 7 are received in spaces 422 between lower base teeth 421. Lower base teeth 421 radially retain strut frame members 7 within lower mounting base 42 by engaging opposed pivot lugs 15 on inner ends 71 of strut frame members 7. Lower cap teeth 411 fit between lower base teeth 421 to retain strut frame members 7 vertically within lower mounting base 42.

Lower base sleeve 423 is an inner sleeve having an inside diameter slightly larger than the outer diameter of the umbrella central shaft. Lower cap sleeve 413 is an outer sleeve which has an inner diameter slightly larger than the outer diameter of lower base sleeve 423. Lower cap sleeve 413 fits over lower base sleeve 423 to form lower mounting ring 4.

Lower mounting ring 4 includes self-locking means which retain lower cap sleeve 413 over lower base sleeve 423. The self-locking means comprises a sleeve section 427 of lower base sleeve 423 which protrudes upwardly from mounting base flange 410. A locking ridge 424 is formed around the end of upwardly protruding sleeve section 427 so that the end of sleeve section 427 has an outer diameter larger than the inner diameter of lower cap sleeve 413. A plurality of slots 425 extend longitudinally into protruding sleeve section 427. Locking ridge 424 is therefore compressible to pass through lower cap sleeve 413. When lower mounting cap 41 is in place over lower mounting base 42, however, protruding sleeve section 427 extends beyond lower cap sleeve 413, allowing locking ridge 424 to expand and to lock lower mounting cap 41 and lower mounting base 42 together as best shown in FIG. 2.

Upper mounting ring 3 is similar to lower mounting ring 4, comprising a upper mounting base 32 and a upper mounting cap 31. Upper mounting base 32 has a longitudinal upper base sleeve 323 which receives the umbrella central shaft. A flange 310 extends radially from upper base sleeve 323. A ring of spaced retaining teeth 321 extend vertically downward from the periphery of flange 310. Spaces 322 are formed between upper base teeth 321.

Upper mounting cap 31 has a longitudinal central cap sleeve 313 which receives the umbrella central shaft. Upper mounting cap 31 has spaced teeth 311 which extend radially from upper cap sleeve 313. Upper cap teeth 311 are complementary in size to spaces 322 of upper mounting base 32. Spaces 312 are formed between upper cap teeth 311, spaces 312 being complementary in size to upper base teeth 321.

Rib frame members 6 are received in spaces 322 between upper base teeth 321. Upper base teeth 321 radially retain rib frame members 6 within upper mounting base 32 by engaging opposed pivot lugs 15 on inner ends 61 of rib frame members 6. Upper cap teeth 311 fit between upper base teeth 321 to retain rib frame members 6 vertically within upper mounting base 32.

Upper cap sleeve 313 is an inner sleeve having an inside diameter slightly larger than the outer diameter of the umbrella center shaft. Upper base sleeve 323 is an outer sleeve which has an inner diameter slightly larger than the outer diameter of upper cap sleeve 313. Upper base sleeve 323 fits over upper cap sleeve 313 to form upper mounting ring 3.

Upper mounting ring 3 includes self-locking means similar to the self-locking means of lower mounting ring 4 to retain upper base sleeve 323 over upper cap sleeve 313. The self-locking means comprises a sleeve section 316 of upper cap sleeve 313 which protrudes upwardly from upper cap sleeve 313. A locking ridge 314 is formed around the end of upwardly protruding sleeve section 316 so that the end of sleeve section 316 has an outer diameter larger than the inner diameter of upper base sleeve 323. A plurality of slots 315 extend longitudinally into protruding sleeve section 316. Locking ridge 314 is therefore compressible to pass through upper base sleeve 323. When upper mounting cap 31 is in place within upper mounting base 32, however, protruding sleeve section 316 extends upward beyond upper base sleeve 323, allowing locking ridge 314 to expand and to lock upper mounting cap 31 and upper mounting base 32 together as shown in FIG. 2.

The umbrella frame construction described above is easily manufactured and assembled. It results in a lightweight umbrella which is conveniently fabricated from modern plastics.

In compliance with the statute, the invention has been described in language more or less specific as to structural features. However, the invention is not limited to the specific features described, since the means herein disclosed comprise preferred forms of putting the invention into effect. The invention is claimed in any of its forms or modifications within the proper scope of the appended claims appropriately interpreted in accordance with the doctrine of equivalents.

I claim:

1. An umbrella frame member for pivotal connection in an umbrella frame, the frame member comprising:

an elongated rod having a notch formed therein;

a joint assembly having longitudinally opposed connector halves, wherein the connector halves mate to form a sleeve over the elongated rod;

an inner boss within the sleeve, the inner boss fitting within the notch in the elongated rod when the connector halves are mated about the elongated rod; and a collar which slides around the mated connector halves to clamp the connector halves together about the elongated rod and to retain the inner boss within the notch in the elongated rod, wherein the inner boss limits longitudinal movement of the joint assembly relative to the elongated rod.

2. The umbrella frame member of claim 1, wherein the joint assembly has at least one laterally extending pivot lug to pivotally connect the frame member in the umbrella frame.

3. The umbrella frame member of claim 1, wherein the joint assembly is an end joint assembly having laterally opposed pivot lugs to pivotally connect the frame member in the umbrella frame.

4. The umbrella frame member of claim 3, wherein the elongated rod has an end joint assembly at each of its ends, the elongated rod forming an umbrella strut which is received at one end by an umbrella runner and at the other end by a midpoint joint assembly on an umbrella rib.

5. The umbrella frame member of claim 1, wherein the joint assembly is adapted to receive pivot lugs to pivotally connect the frame member relative to the pivot lugs.

6. The umbrella frame member of claim 1, wherein the joint assembly has tab extensions which are adapted to receive pivot lugs to pivotally connect the frame member relative to the pivot lugs.

7. The umbrella frame member of claim 1, wherein the elongated rod has a joint assembly at each of its ends, the elongated rod forming an umbrella strut which is received at one end by an umbrella runner and at the other end by a joint assembly on an umbrella rib.

8. An umbrella frame member for pivotal connection in an umbrella frame, the frame member comprising:

an elongated rod having a notch formed therein;

a pair of connector halves surrounding the rod in opposition to one another, the connector halves including an inner boss fitting within the notch in the elongated rod; and a collar mounted about the connector halves to clamp the connector halves together about the elongated rod and to retain the inner boss within the notch in the elongated rod.

9. The umbrella frame member of claim 8, wherein the rod has a pair of notches formed in opposition to one another and each of the connector halves includes an inner boss fitting within the respective opposed notches.

10. The umbrella frame member of claim 8, wherein each of the connector halves includes a laterally extending pivot lug adapted to pivotally connect the rod within an umbrella frame.

11. The umbrella frame member of claim 8, wherein each of the connector halves includes a tab extension adapted to pivotally connect the rod within an umbrella frame.

12. The umbrella frame member of claim 8, wherein the collar is slidably mounted on the rod.

13. A pivotal joint assembly for an umbrella frame, comprising:

a first elongated rod having a notch formed therein adjacent one of its ends;

a first pair of connector halves surrounding the first rod in opposition to one another, the first pair of connector halves including an inner boss fitting within the notch in the first rod; and a first collar mounted about the first pair of connector halves to clamp the first pair of connector halves together about the first rod and to retain their inner boss within the notch in the first rod;

each of the connector halves in the first pair including an end section protruding beyond the one end of the first rod and having a laterally extending pivot lug formed thereon;

a second elongated rod having a notch formed therein intermediate its ends;

a second pair of connector halves surrounding the second rod in opposition to one another, the second pair of connector halves including an inner boss fitting within the notch in the second rod;

a second collar mounted about the connector halves to clamp the connector halves together about the elongated rod and to retain the inner boss within the notch in the first elongated rod;

each of the connector halves of the second pair including a center section having a tab extension with an aperture adapted to receive one pivot lug of the first pair of connector halves with the end sections of the first pair of connector halves overlapped by the tab extensions of the second pair of connector halves to thereby pivotally interconnect the first and second rods.

14. An umbrella mounting ring which pivotally receives ends of umbrella frame members, the frame members extending radially from the mounting ring and having laterally extending pivot lugs at their ends, the mounting ring comprising:

a mounting base having a ring of spaced and vertically extending teeth, the frame members being received between the teeth, the teeth radially retaining the frame members within the mounting base by engaging the frame member pivot lugs; and a mounting cap which mates with the mounting base, the mounting cap having radially extending spaced teeth which fit between the teeth of the mounting base to retain the frame members within the mounting base.

15. The umbrella mounting ring of claim 14, wherein the umbrella has a central shaft which is received through the mounting base and the mounting cap.

16. The umbrella mounting ring of claim 14, wherein the mounting ring is slidably received over an umbrella central shaft to form an umbrella runner.

17. An umbrella mounting ring which fits over a central shaft of an umbrella and which pivotally receives ends of umbrella frame members, the frame members extending radially from the mounting ring and having laterally extending pivot lugs at their ends, the mounting ring comprising:

a mounting base having a longitudinal central base sleeve which receives the umbrella central shaft, the mounting base having a flange which extends radially from the base sleeve and a ring of spaced retaining teeth extending vertically from the periphery of the flange; wherein the frame members are received between the teeth and the teeth radially retain the frame members within the mounting base by engaging the frame member pivot lugs; and a mounting cap having a longitudinal central cap sleeve which receives the umbrella central shaft, the mounting cap having spaced teeth which extend radially from the central cap sleeve and which fit between the teeth of the mounting base to retain the frame members within the mounting base; and wherein one of the central base and cap sleeves is an inner sleeve which fits over the umbrella shaft and the other of the central base and cap sleeves is an outer sleeve which fits over the inner sleeve.

18. The umbrella mounting ring of claim 16, wherein the inner sleeve has self-locking means which retain the inner sleeve within the outer sleeve.

19. The umbrella mounting ring of claim 16, wherein the mounting ring slides over the umbrella central shaft to form an umbrella runner.

20. A pivotal joint assembly for an umbrella frame, comprising:

an elongated rod having a notch formed therein adjacent one of its ends;

a pair of connector halves surrounding the rod in opposition to one another, the connector halves including an inner boss fitting within the notch in the elongated rod; and a collar mounted about the connector halves to clamp the connector halves together about the elongated rod and to retain the inner boss within the notch in the elongated rod;

each of the connector halves including an end section protruding beyond the one end of the rod and having a laterally extending pivot lug formed thereon;

an umbrella mounting ring which pivotally receives the laterally extending pivot lugs at the end sections of the connector halves; the mounting ring comprising:

a mounting base having a ring of spaced teeth, the end sections of the connector halves being received between the teeth, the teeth radially retaining the connecting halves within the mounting base by engaging the pivot lugs; and a mounting cap which mates with the mounting base, the mounting cap having radially extending spaced teeth which fit between the teeth of the mounting base to retain the connecting halves and pivot lugs within the mounting base.

* * * * *